US006381998B1

(12) United States Patent
Good

(10) Patent No.: US 6,381,998 B1
(45) Date of Patent: May 7, 2002

(54) GOLF BAG SECURITY DEVICE

(76) Inventor: Stanley B. Good, 2810 Bluebird La., Columbus, MI (US) 48463

( * ) Notice: Subject to any disclaimer, the term of this patent is extended or adjusted under 35 U.S.C. 154(b) by 0 days.

(21) Appl. No.: 09/407,117

(22) Filed: Sep. 27, 1999

Related U.S. Application Data

(60) Provisional application No. 60/116,961, filed on Jan. 22, 1999.

(51) Int. Cl.[7] ..... A63B 55/00; E05B 73/00

(52) U.S. Cl. ..... 70/58; 70/18; 70/64; 206/315.3; 206/315.6

(58) Field of Search ..... 70/18, 49, 57, 70/58, 64; 211/70.2; 206/315.2–315.8

(56) References Cited

U.S. PATENT DOCUMENTS

| | | | | | |
|---|---|---|---|---|---|
| 1,717,959 | A | | 6/1929 | Cauffman | 340/568 |
| 1,731,588 | A | | 10/1929 | Patterson | |
| 1,770,060 | A | | 7/1930 | Barlow | |
| 4,057,983 | A | | 11/1977 | Morgan | 70/18 |
| 4,538,728 | A | | 9/1985 | Lewis | 206/315.3 |
| 4,753,446 | A | | 6/1988 | Mills | 280/47.18 |
| 4,860,889 | A | | 8/1989 | Lemieux et al. | 206/315.6 |
| 4,863,019 | A | | 9/1989 | Lewis et al. | 206/315.3 |
| 4,915,221 | A | | 4/1990 | Spangler | 206/315.6 |
| 4,979,382 | A | | 12/1990 | Perry | 70/58 |
| 5,004,100 | A | | 4/1991 | Smith | 206/315.2 |
| 5,029,703 | A | | 7/1991 | Dulyea, Sr. | 206/315.3 |
| 5,060,796 | A | | 10/1991 | Brooks, III | 206/315.6 |
| 5,267,660 | A | | 12/1993 | Kwon | 211/70.2 |
| 5,267,669 | A | | 12/1993 | Dixon et al. | 220/465 |
| 5,306,046 | A | * | 4/1994 | Stanley | 70/58 X |
| D366,202 | S | | 1/1996 | Murphy | D8/333 |
| D366,203 | S | | 1/1996 | Murphy | D8/333 |
| 5,493,274 | A | | 2/1996 | Long | 340/568 |
| 5,505,300 | A | | 4/1996 | Joh | 206/315.6 |
| 5,524,753 | A | | 6/1996 | Murphy | 206/315.6 |
| 5,531,083 | A | | 7/1996 | Franck, III et al. | 70/58 |
| 5,560,485 | A | | 10/1996 | O'Hara, Jr. | 206/315.4 |
| 5,582,043 | A | | 12/1996 | McCue et al. | 70/58 |
| 5,590,772 | A | | 1/1997 | Schuhlen et al. | 206/315.3 |
| 5,610,585 | A | | 3/1997 | Jobe | 340/568 |
| 5,636,734 | A | | 6/1997 | Smith | 206/315.2 |
| 5,636,735 | A | | 6/1997 | Stusek | 206/315.6 |
| 5,645,166 | A | * | 7/1997 | Su | 206/315.3 X |
| 5,775,513 | A | * | 7/1998 | Anthony | 206/315.3 |
| 5,918,490 | A | | 7/1999 | Lion | 70/58 |
| 5,971,146 | A | | 10/1999 | Jones | 206/315.3 |
| 6,006,904 | A | | 12/1999 | Jacobsen | 206/315.6 |
| 6,053,312 | A | * | 4/2000 | Smith | 211/70.2 X |
| 6,062,050 | A | * | 5/2000 | Lion | 70/18 X |
| 6,112,895 | A | * | 9/2000 | Ryan | 70/58 X |
| 6,196,385 | B1 | * | 3/2001 | Thompson et al. | 70/64 X |

FOREIGN PATENT DOCUMENTS

| | | | | |
|---|---|---|---|---|
| CA | 2181410 | | 1/1997 | |
| FR | 2 646 785 | | 11/1990 | |
| GB | 2234 912 | * | 2/1991 | 206/315.3 |
| WO | WO96/04045 | | 2/1996 | |

* cited by examiner

*Primary Examiner*—Lloyd A. Gall
(74) *Attorney, Agent, or Firm*—Pillsbury Winthrop LLP

(57) ABSTRACT

The present invention relates to a golf bag security device. One aspect of the present invention relates to a golf bag security device that has both a club retaining assembly and a bag securing assembly that are both locked by a single releasable lock. Another aspect of the invention relates to a golf bag security device that uses a plurality of fingers to retain the clubs therein.

29 Claims, 11 Drawing Sheets

GOLF BAG SECURITY DEVICE

The present application claims priority to U.S. Provisional Patent Application of Good, Serial No. 60/116,961, filed Jan. 22, 1999, the entirety of which is hereby incorporated into the present application by reference.

FIELD OF THE INVENTION

The present invention relates to a golf bag security device.

BACKGROUND OF THE INVENTION

As the popularity of golf as both a competitive and recreational sport continues to grow, unfortunately so does the opportunity for theft of golf clubs, golf bags and other equipment. Typically, a golf course provide stands outside of the clubhouse and pro shop where golfers often leave their bags unattended. These unattended golf bags provide an easy target for thieves.

U.S. Pat. No. 5,524,753 discloses a device for securing golf clubs within a golf bag. The device comprises a set of plates each having a number of slots formed therethrough. In a releasing position, the plates are positioned such that the slots are aligned with one another to provide openings that allow the clubs to be removed freely from the bag. In a locking position, the lower plate is moved relative to the upper plate so that the associated pairs of slots are shifted to these narrow openings. In this locking position, when one tries to remove the golf club from the bag, the shoulder surfaces defined on the club grip will engage the lower wall and prevent further outward movement of the club. However, the device of the '753 patent has no way of securing the golf bag to a stationary object. Thus, a thief could steal the golf bag and golf clubs by carrying it away. In fact, most thieves would prefer stealing the entire bag because removing individual clubs from a bag is conspicuous.

SUMMARY OF THE INVENTION

It is therefore an object of the present invention to provide a device which can be installed in a golf bag which device functions effectively to prevent removal of individual clubs and further prevents carrying away of the entire golf bag with the clubs therein. In order to achieve such an object, the present invention provides a golf bag security device for installation on a golf bag having an open interior space configured to receive a plurality of golf clubs, each of the golf clubs having an elongated shaft with a head on one end and a manually engagable grip on the other end, the grip defining a shoulder surface facing generally toward the head. The golf bag security device is comprised of a club retaining assembly that fixedly mounts to the bag when the device is installed. The club retaining assembly has a plurality of club receiving openings formed therethrough and each of the openings is positioned and configured to receive an associated one of the golf clubs. When the clubs are in the openings, the head of each club is disposed exteriorly of the club retaining assembly and the grip of each club is disposed interiorly of the club retaining assembly when the device is installed in the bag.

The club retaining assembly provides shoulder engaging surfaces that face interiorly into the bag when the golf bag security device is installed. The golf bag security device includes an actuating mechanism operatively associated with the club retaining assembly and has a manually operable portion. When the golf bag security device is installed in the golf bag and a plurality of golf clubs are received in the openings, manual operation of the manually operable portion of the activating mechanism moves the club retaining assembly between (1) a club retaining position wherein each of the shoulder engaging surfaces is positioned to engage the shoulder surface on the grip of the associated golf club during outward movement of the associated golf club so as to prevent the removal of the golf club from the golf bag and (2) a club releasing position wherein each of the shoulder engaging surfaces is positioned to allow the clubs to be removed from the golf bag.

The golf bag security device also includes a golf bag securing assembly that moves between (1) a bag securing position wherein the bag securing assembly secures the golf bag to a fixed object when the device is installed, thereby preventing the golf bag with the clubs therein from being carried away and (2) a bag releasing position wherein the golf bag with the golf clubs therein can be carried away from the fixed object. The golf bag security device also includes a single releasable lock that moves between a releasably locked position locking both the club retaining assembly in the club retaining position thereof and the bag securing assembly in the bag securing position thereof and a released position allowing both the club retaining portion to be moved to the club releasing position thereof and the bag securing assembly to be moved to the bag releasing position thereof.

The club retaining assembly preferably comprises a club retaining portion defined by a multiplicity of cammable fingers depending from a base portion with a number of the cammable fingers being arranged around each of the club receiving openings. The cammable fingers provide the shoulder engaging surfaces. The actuating mechanism includes a movable camming member having camming surfaces operatively associated with each of the cammable fingers. Alternatively, the cammable fingers could be provided on the movable member and the camming surfaces could be provided on the base portion. The actuating mechanism is constructed and arranged such that manual operation of the manually operable portion moves the movable camming member such that the camming surfaces thereof cam the cammable fingers inwardly with respect to the club receiving openings so that each of the shoulder engaging surfaces is positioned to engage the shoulder surface on the grip of an associated club during outward movement of the associated club so as to prevent club removal, thereby realizing the club retaining position of the club retaining portion.

This "fingered" arrangement provides enhanced security against club removal in comparison to the '753 patent. Specifically, the device of the '753 patent only engages the clubs at two points on opposing sides thereof. The edges which secure the clubs, in effect, only contact the club shaft at two tangential points. A thief could remove a club from the bag by working it back and forth along the slot while pulling the club upwardly. The fingers utilized in the arrangement of the present invention allow more than two points of contact and, when more than two fingers are used, limit movement of the club so that it cannot be moved back and forth and worked out of the bag. Preferably, the shoulder engaging surfaces of the finger have arcuate configurations to ensure that full contact is made between the surface and the club.

The manually operable portion is rotatably mounted to the base portion such that rotational movement of the manually operable portion moves the movable camming member toward and away from the base portion. The bag securing assembly preferably comprises a flexible cable configured to be wrapped around the fixed object. The cable has a lockable member on the free end thereof. The base portion has a concave exteriorly facing surface and the manually operable portion of the actuating mechanism comprises an arm member with a concave interiorly facing surface. The concave interiorly facing surface of the arm member and the concave exteriorly facing surface of the base portion are constructed and arranged such that the lockable member can be wrapped around the stationary object and positioned on the exteriorly facing surface. The manually engageable portion can then be rotated to cam cammable fingers inwardly with respect to the club receiving openings and to position the concave interiorly facing surface such that the interiorly facing surface and the exteriorly facing surface cooperate to prevent removal of the lockable member, thereby realizing the bag securing position of the bag securing assembly and the releasable lock can thereafter be moved into the locked position locking both the club retaining portion in the club retaining position thereof and the bag securing assembly in the bag securing position thereof.

It can be appreciated that a golf bag security device constructed in accordance with the principles of the present invention provides enhanced security by preventing theft of both the bag and the individual clubs. A golfer using the device of the present invention can leave his clubs and bag unattended without fear of theft. When he leaves the bag unattended, he simply secures the bag securing assembly to the stationary object such as a stand or fence post and then operates the actuating mechanism so as to move the retaining members into their club retaining positions and thereafter moves the lock into its releasably locked position so as to lock both the retaining members in the club retaining position and the bag securing assembly in the bag securing position.

Further, the device is unobtrusive when mounted in the bag and can be constructed from lightweight material so as not to significantly increase by weight. The device can be installed in golf bags without the need for additional components to be fastened or built into the body of the bag.

Other objects, features and advantages of the present invention will become apparent from the following detailed description, the accompanying drawings and the appended claims.

DETAILED DESCRIPTION OF THE PREFERRED EMBODIMENT OF THE INVENTION

Figure 1:
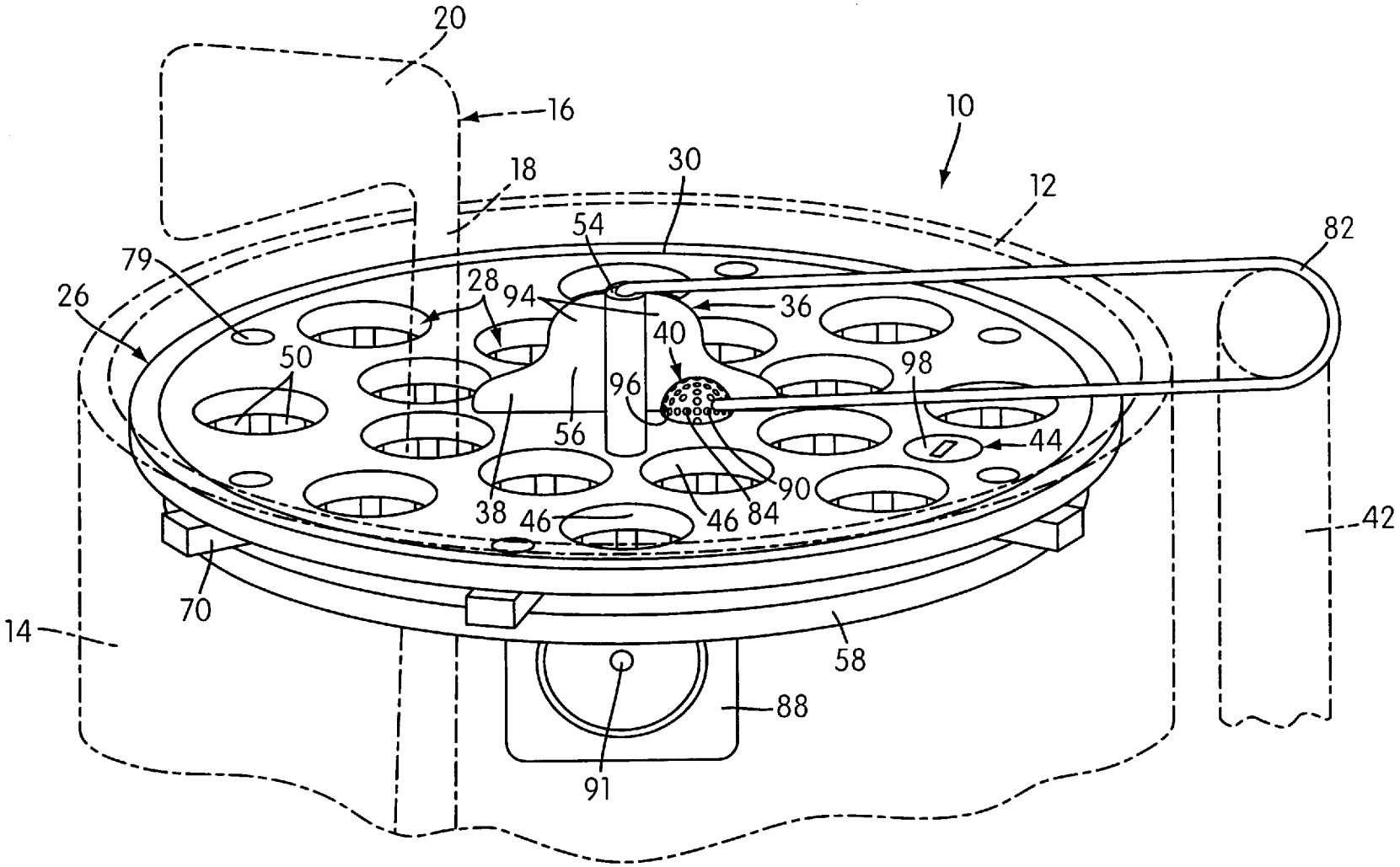
FIG. 1 is a fragmentary perspective view of a golf bag security device constructed according to the principles of the present invention showing the golf bag security device installed in a conventional golf bag shown in phantom lines and showing a bag securing assembly of the device in a bag securing position wherein the bag securing assembly secures the golf bag to a fixed object.

FIG. 1 shows a golf bag security device, generally designated 10, for installation in a golf bag 12 that has an open interior space 14 configured to receive a plurality of conventional golf clubs. A representative club 16 is shown in phantom lines in FIG. 1. The club 16 has an elongated shaft 18 with a head 20 on one end and a manually engageable grip 22 (not visible in FIG. 1, but shown in FIG. 5) on the opposite end. The grip 22 defines a shoulder surface 24 facing generally towards the head 20.

The golf bag security device 10 includes a club retaining assembly 26 that fixedly mounts within the interior space 14 of the golf bag 12, as shown in FIG. 1. The club retaining assembly 26 has a plurality of club receiving openings 28 formed therethrough. Each of the club receiving openings 28 receives an associated one of the golf clubs 16 with the head 20 of each club 16 disposed exteriorly of the club retaining assembly 26 and the grip 22 of each club 16 disposed interiorly of the club retaining assembly 26 when the device 10 is mounted in the bag.

The club retaining assembly 26 includes a base portion 30 and a club retaining portion, generally designated 32, that are movable relative to one another. The club retaining assembly 26 has shoulder engaging surfaces 34 that are positioned and configured to face interiorly into the golf bag 12 when the device 10 is installed and that can be selectively repositioned to allow the club 16 to be removed from the bag or to prevent removal of the club 16 from the bag.

More specifically, an actuating mechanism 36 is operatively associated with the club retaining portion 32 of the club retaining assembly 26 and has a manually operable portion 38 that extends outwardly from the golf bag security device 10 when the device is installed in the golf bag 12 as shown, for example, in FIG. 1. The actuating mechanism 36 is constructed and arranged such that, when the device 10 is installed in the golf bag 12 and a plurality of the clubs 16 are received in the club receiving openings 28, manual operation of the manually operable portion 38 of the actuating mechanism 36 moves the club retaining portion 32 relative to the base portion 30 between (1) a club retaining position (shown, for example, in FIG. 5) wherein each of the shoulder engaging surfaces 34 is positioned to engage the shoulder surface 24 on the grip 22 of an associated club 16 during outward movement of the associated club 16 so as to prevent attempted club 16 removal and (2) a club releasing position (shown, for example, in FIG. 3) wherein each of the shoulder engaging surfaces 34 is positioned to allow the clubs 16 to be removed from the golf bag 12.

The base portion 30 is a cylindrical structure preferably made of a light weight material such as a high strength plastic or aluminum and has a plurality of apertures 46 around the periphery thereof and a central aperture 48.

The club retaining portion 32 comprises a multiplicity of cammable fingers 50 depending from the base portion 30 with a number of the cammable fingers 50 being arranged around each of the apertures 46. Each cammable finger 50 is a spring-like structure preferably made of steel and covered by a plastic coating 52 to protect the club 16 from damage when the cammable fingers 50 come in contact with the shaft 18. Alternatively, the fingers 50 could be made from a composite material such as fiberglass. The cammable fingers provide the shoulder engaging surfaces 34.

As shown, the spring steel portions of the fingers 50 are press-fit into slots formed in the base portion 30. An optional method of mounting the fingers 50 is to pivotally mount the fingers 50 on individual pivot pins and provide a biasing or tensioning element for urging the fingers 50 outwardly away from the club shaft. Such a tensioning or biasing element could be a clock spring wound about the pivot pins.

It should be noted that the side edges of the fingers 50 taper inwardly towards the free ends of the fingers 50. This tapering ensures that the fingers 50 will not interfere with each other as they move inwardly towards the club shaft.

Figure 3:
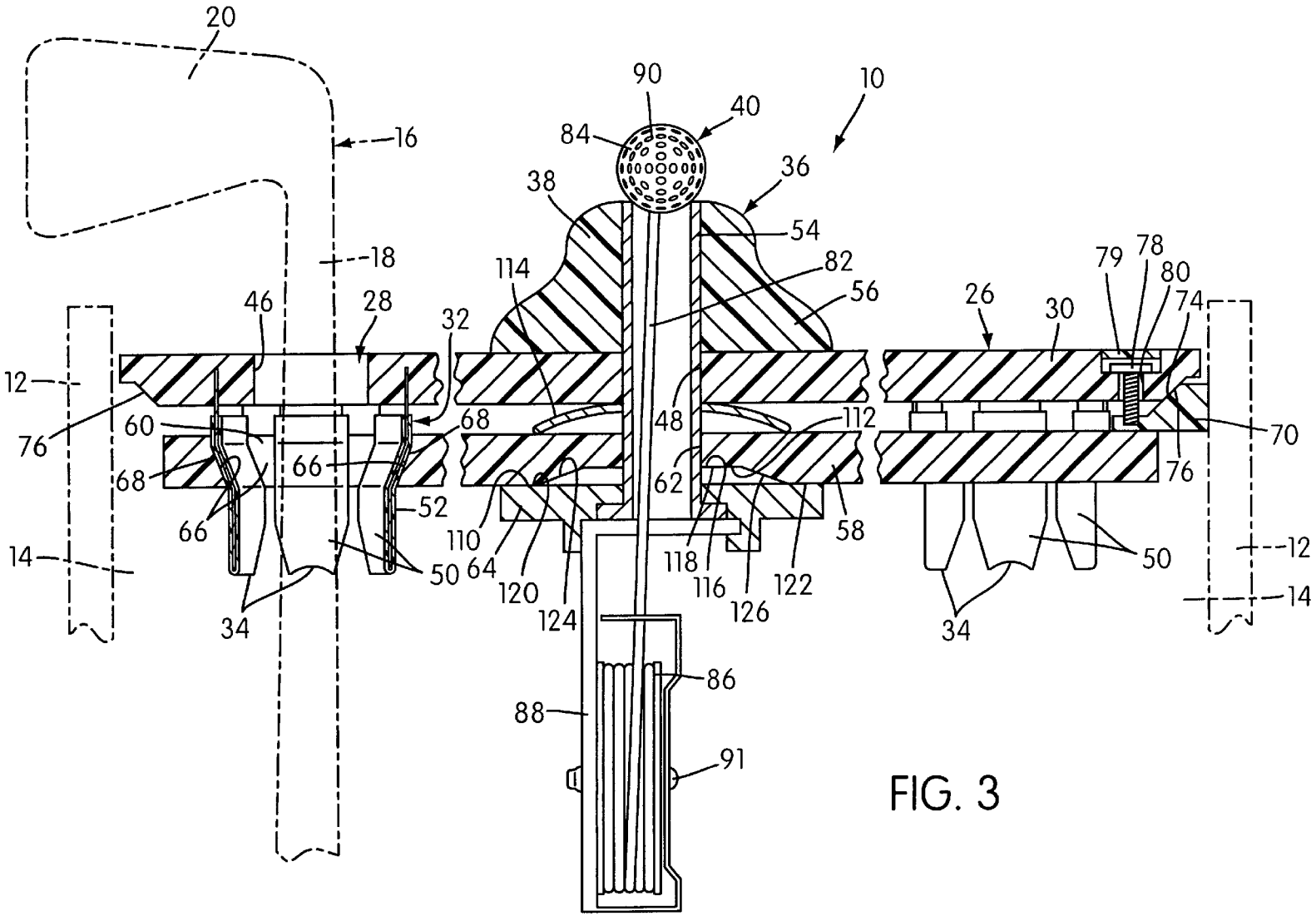
FIG. 3 is a cross-sectional view of the golf bag security device taken through the line 3—3 in FIG. 2.

The actuating mechanism 36 is rotatably mounted in the central aperture 48 of the base portion 30 as shown, for example, in FIG. 3. The actuating mechanism 36 includes a tubular portion 54 preferably molded from plastic and a handle portion 56 which comprises part of the manually operable portion 38 rigidly secured to an upper portion of the tubular portion 54. The handle portion 56 is also preferably made of plastic. In fact, it is preferred to mold the handle portion 56 and the tubular portion 54 together as one integral unit to save on component and assembly costs. The actuating mechanism 36 also includes a movable camming member 58 that is preferably a thin cylindrical structure made of a light weight material such as a high strength plastic or aluminum. The movable camming member 58 has a plurality of peripheral apertures 60 and a central aperture 62. The peripheral apertures 46 on the base portion 30 and the apertures 60 on the movable camming member 58 are aligned and cooperate to form the club receiving openings 28 of the club retaining assembly 26. The movable camming member 58 is slidably disposed on the tubular portion 54 of the actuating mechanism 36 and a camming structure 64 is rigidly mounted on the lower end of the tubular portion 54. The movable camming member 58 has camming surfaces 66 formed within each peripheral aperture 60 that are operatively associated with each of the associated cammable fingers 50.

The actuating mechanism 36 is constructed and arranged such that manual operation of the manually operable portion 38 moves the movable camming member 58 such that the camming surfaces 66 thereof cam the cammable fingers 50 inwardly with respect to the club receiving openings 28 so that each of the shoulder engaging surfaces 34 is positioned to engage the shoulder surface 24 on the grip 22 of an associated club 16 during outward movement of the associated club 16 so as to prevent club removal, thereby realizing the club retaining position of the club retaining portion 32.

The cammable fingers 50 have cammable surfaces 68 that taper towards one another in a direction away from the base portion 30. As will become apparent, manual operation of the manually operable portion 38 moves the movable camming member 58 upwardly towards the base portion 30 so that the camming surfaces 66 engage the cammable surfaces 68 and cam the fingers 50 inwardly.

Figure 4:
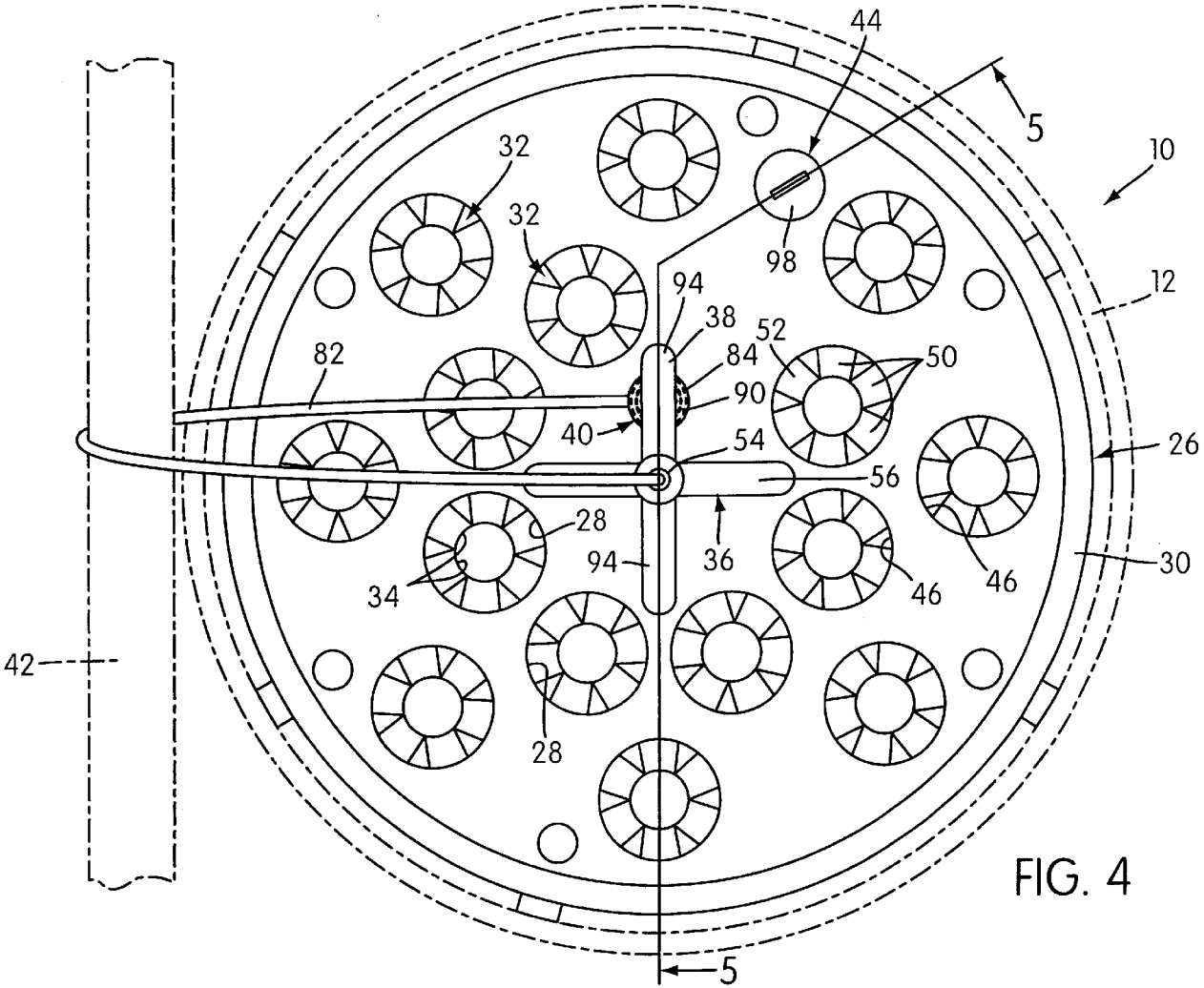
FIG. 4 is a top plan view similar to the view of FIG. 2 showing the bag securing assembly of the device in the bag securing position.

The golf bag security device 10 further includes a bag securing assembly, generally designated 40, for securing the golf bag 12 to a fixed object 42 when the bag is left unattended. The bag securing assembly 40 is constructed and arranged to be moved between (1) a bag securing position (shown in FIGS. 1, 4–5) wherein the securing assembly secures the golf bag to a fixed object 42, when the device 10 is installed in the golf bag 12, thereby preventing the bag 12 and the clubs 16 therein from being carried away and (2) a bag releasing position (shown in FIGS. 2–3 ) wherein the golf bag 12 and the clubs 16 therein can be carried away from the fixed object 42.

The golf bag security device 10 is provided with a single releasable lock 44 that moves between (1) a releasably locked position locking both the club retaining portion 32 in the club retaining position thereof and the bag securing assembly 40 in the bag securing position thereof and (2) a released position allowing both the club retaining portion 32 to be moved to the club releasing position thereof and the bag securing assembly 40 to be moved to the bag releasing position thereof.

A plurality of support members 70 are provided. Each of the support members 70 has an angled surface 74 and the base portion 30 has a beveled edge 76. The support members 70 are spaced circumferentially around the angled edge 76 of the base portion 30 and initially secured by screws 78. In this initial position, the angled surfaces 74 are engaged with the beveled edge 76.

The installer then places the device 10 inside the bag 12 and tightens screws 78. As the screws 78 are tightened, the support members 70 will be pulled upwardly and the engagement between the angled surfaces 74 and the beveled edge 76 will force the support members radially outwardly into tightened engagement with the bag wall. This tightened engagement will secure the device 10 in place. Decorative covers 79 fit over the screws 78 to conceal them from view.

Alternatively, the support members 70 may be omitted and screws (not shown) may be driven through the bag wall and into the base portion 30. This mounting arrangement, however, is not preferred because of the damage it causes to the golf bag 12. Using the support members 70 is relatively simple and causes no damages to the bag 12.

The bag securing assembly 40 includes a flexible cable 82 that is configured to be wrapped around a fixed object such as the representative fixed object 42 shown in FIG. 1. The fixed object may be a fence post, a club rack, structure on the interior of a pick-up truck bed, etc. The flexible cable 82 is a high strength structure preferably made of steel or other metal of suitable strength and has a lockable member 84 on a free end thereof. The end of the flexible cable 82 opposite the free end is mounted on a retractor in the form of spring biased spool 86 that is rotatably mounted on a plate 88 that extends downwardly from and is rigidly secured to the camming structure 64 of the club retaining assembly 26. The plate 88 rotates with the camming structure 64. The lockable member 84 is a spherical structure that preferably has a metal core (not shown) and an outer plastic coating 90. The plastic coating 90, shown, for example, in FIG. 3, is decoratively dimpled to give the lockable member 84 the aesthetic appearance of a golf ball.

The spool 86 is spring biased in a cable winding direction to wind the flexible cable 82 thereabout so that the flexible cable 82 is normally wound around the spool 86 and the lockable member 84 is retained in the top opening of the tubular portion 54 of the actuating mechanism 36 as shown in FIG. 3. A clock-type spiral spring (not shown) is mounted between a fixed rotational axis (formed by a rivet 91 that mounts the spool 86 to the plate 88) of the spring biased spool 86 and the portion of the spool 86 that carries the cable. When the spool 86 rotates in a cable unwinding direction, the spiral spring is tensioned so that the spool 86 rotates in a winding direction when the flexible cable 82. is released to wind the cable back around the spool 86.

Figure 5:
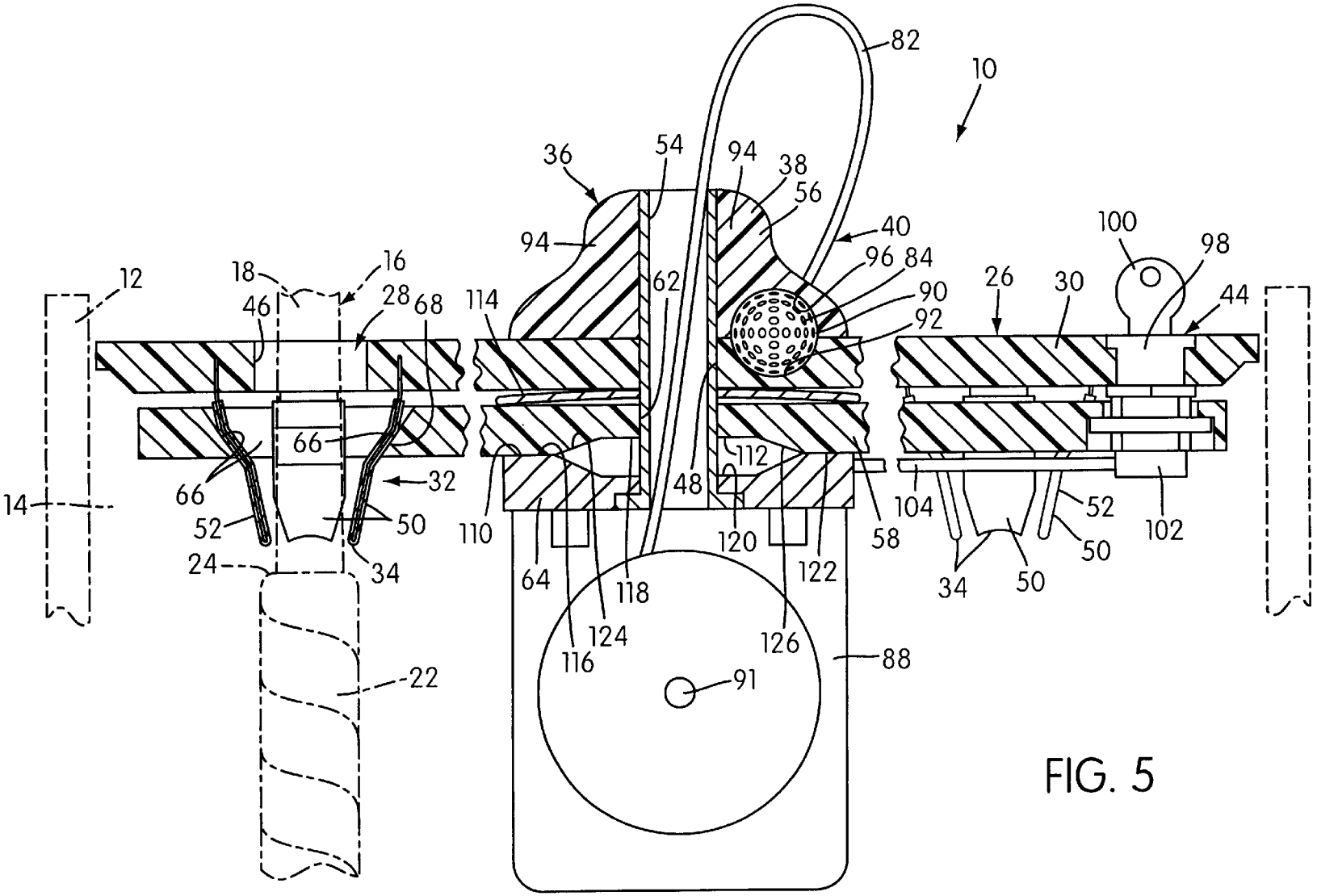
FIG. 5 is a cross-sectional view of the golf bag security device taken through the line 5—5 in FIG. 4.

The base portion 30 has a concave exteriorly facing surface 92 configured to receive the spherical lockable member 84 as shown in FIG. 5. The handle portion 56 of the manually operable portion 38 of the actuating mechanism 36 has two arm members 94 that each have a concave interiorly facing surface 96 as shown in FIG. 5.

Figure 6:
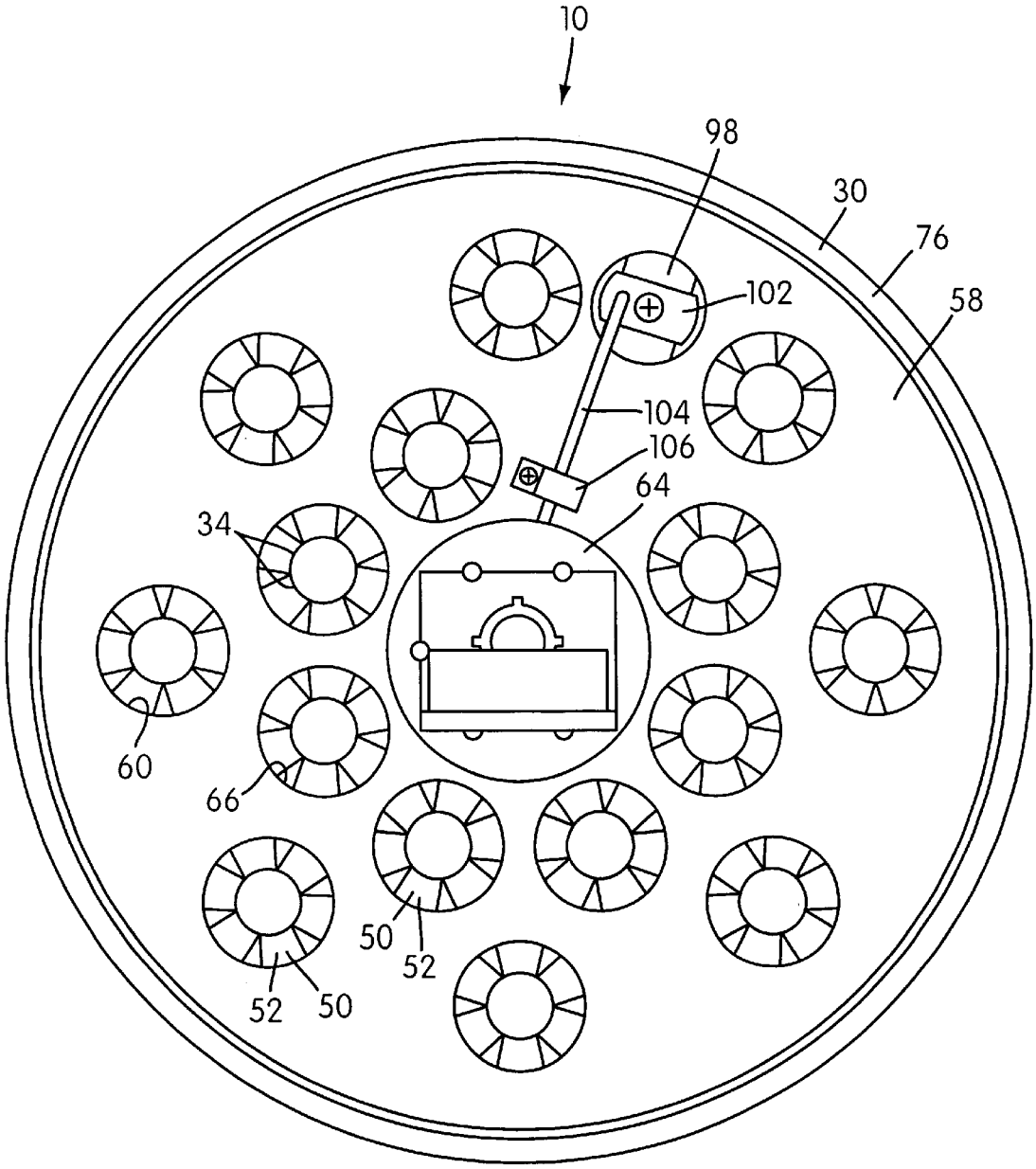
FIG. 6 is a bottom plan view of the golf bag security device.
Figure 7:
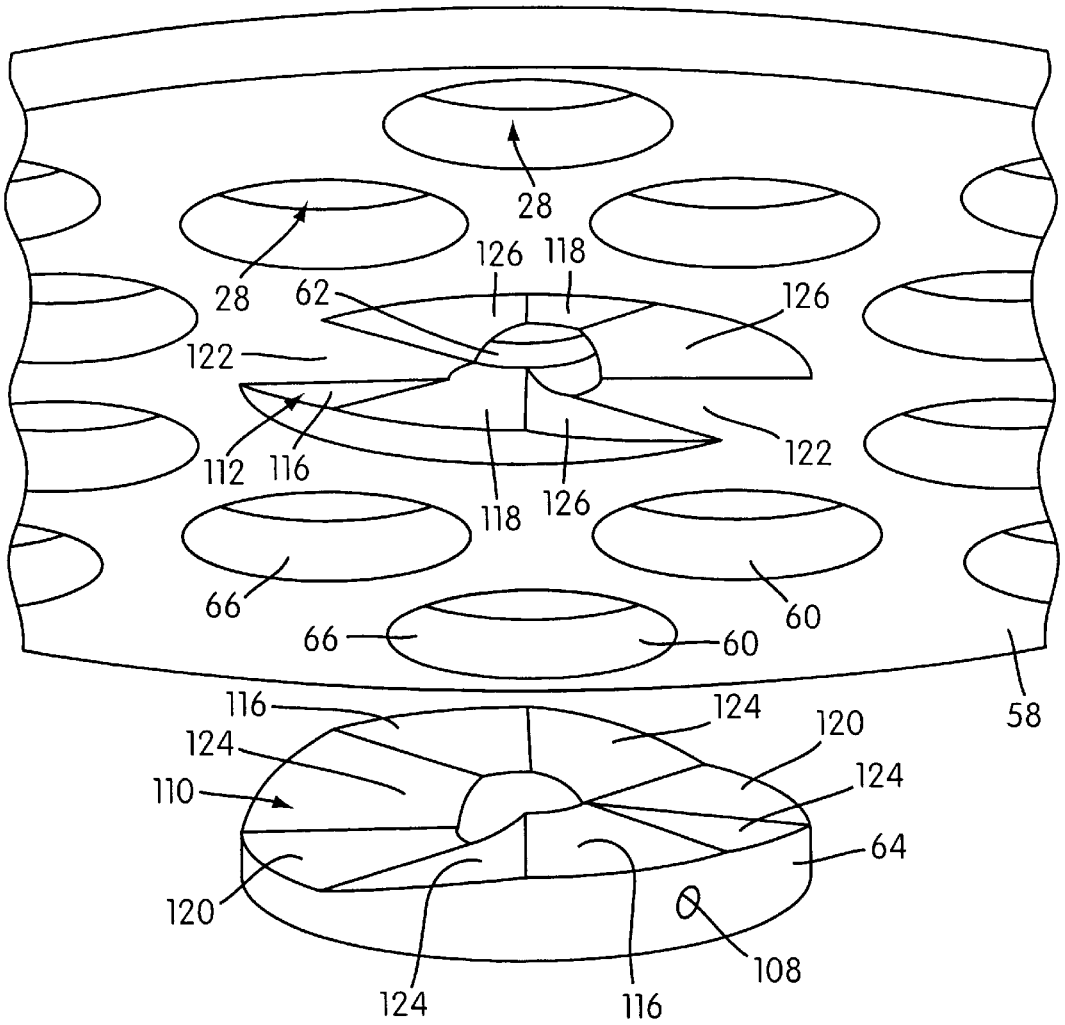
FIG. 7 is an exploded view of a portion of the golf bag security device showing the camming structure.

The single releasable lock 44 is best seen in FIGS. 5–6. The single releasable lock 44 has a key-operated lock cylinder 98 that can be rotated with a key 100 with respect to the base portion 30. The single releasable lock 44 is mounted within an aperture 98 within the base portion 30. When the cylinder is rotated using the key 100, a planar bottom member 102, best seen in FIG. 6, rotates therewith causing a sliding movement of a locking rod 104 in a generally radial direction with respect to the camming structure 64 within a support bracket 106 so that the locking rod 104 moves in and out of engagement with a bore 108 formed in the camming structure 64. There are two bores 108 formed on the camming structure 64 and they are spaced approximately one hundred and eighty degrees apart. Only one is shown in FIG. 7. The camming structure 64 is shown perspective view in FIG. 7 and the bore 108 is visible on the side thereof which receives the free end of the locking rod 104.

Operation of the Golf Bag Security Device

Figure 2:
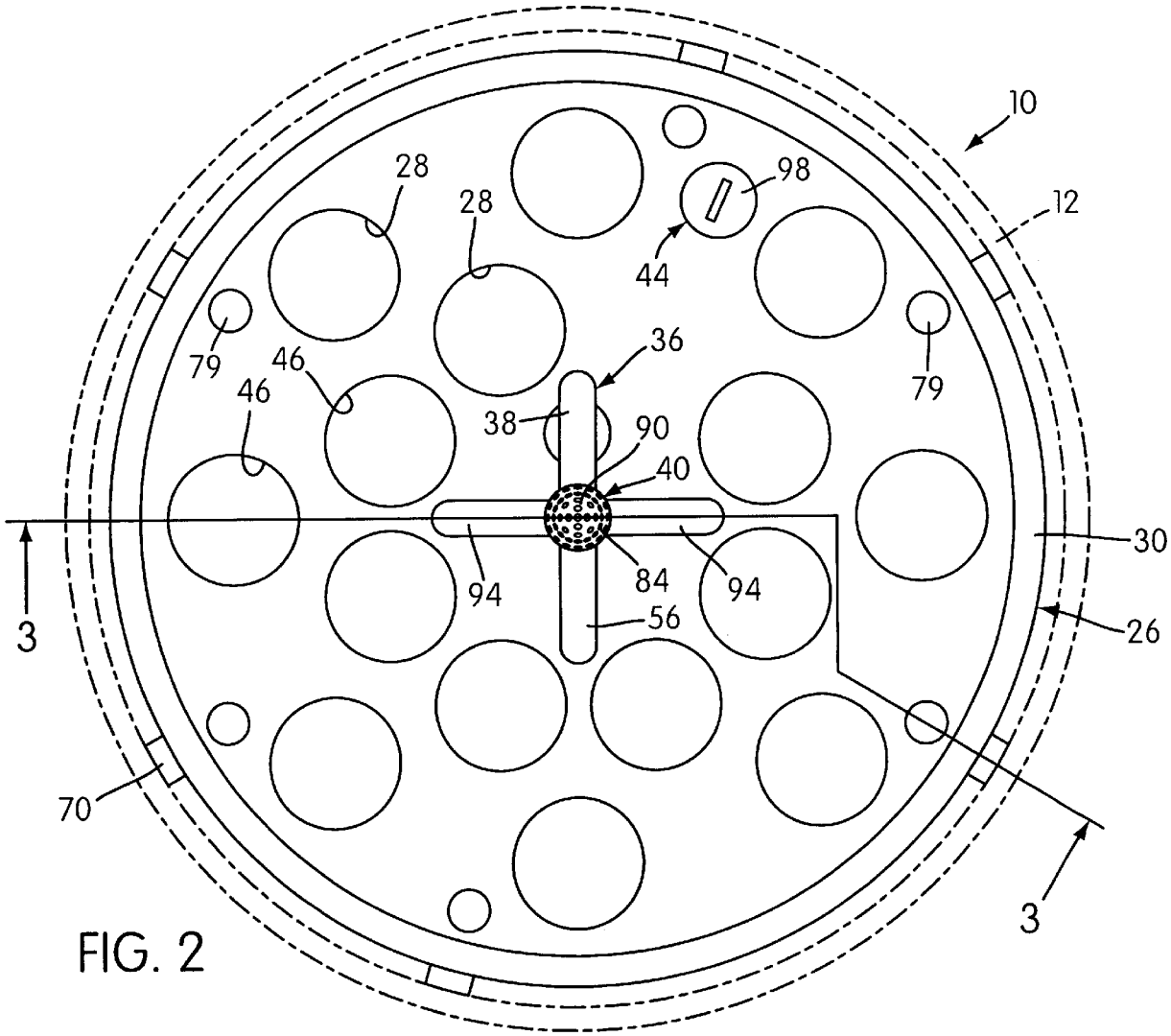
FIG. 2 is a top plan view of the golf bag security device showing the bag securing assembly f the device in a bag releasing position.

The operation of the golf bag security device 10 can best be appreciated by examining FIGS. 1–5. FIGS. 2–3 show the configuration of the golf bag security device 10 when the clubs 16 are freely removable from the golf bag 12 and the golf bag 12 can be freely carried as, for example, during a golf game.

In this configuration, the lockable member 84 is positioned on top of the tubular portion 54 of the actuating mechanism 36 and is held there as shown in FIG. 3 by the spring force of the spring associated with the spring biased spool 86. The cammable fingers 50 are resiliently flexible and are constructed so that when the cammable fingers 50 move to their unflexed configurations, they move outwardly from the associated club receiving opening 28 to their club releasing positions (shown in FIG. 3). In the club releasing positions, each of the shoulder engaging surfaces 34 is positioned to allow the clubs 16 to be removed from the golf bag 12.

When it is desired to lock the clubs in the golf bag 12 and to lock the golf bag 12 to a fixed object 42, the bag is placed next to the fixed object 42 and the lockable member 84 and the flexible cable 82 are manually pulled outwardly from the tubular portion 54 of the actuating mechanism 36. The flexible cable 82 is then wrapped around the fixed object 42 as shown in FIG. 1. The handle portion 56 of the manually operable portion 38 is manually rotated to move the arm member 94 of the handle portion 56 away from the concave exteriorly facing surface 92 of the base portion 30 so that the lockable member 84 can be placed therein.

It can be appreciated from FIG. 3 that when the handle portion 56 of the manually operable portion 38 is rotated, the handle portion 56, the tubular portion 54 and the camming structure 64 rotate as a unit. As the camming structure 64 rotates, a camming surface 110 on the camming structure 64 and a central camming surface 112 on the movable camming member 58 cooperate to move the movable camming member 58 upwardly toward the base portion 30 in a direction parallel to the axis of the tubular portion 54 of the actuating mechanism 36.

It can be appreciated from FIG. 7 that the camming surfaces 110, 112 are of complementary configuration and that each has two raised portions designated 116 and 118, respectively, spaced 180 degrees apart, two low portions designated 120 and 122, respectively, spaced 180 degrees apart, and sloped portions 124, 126, respectively, extending therebetween.

When the low portions 122 of the central camming surface 112 of the movable camming member 58 are engaged in overlying relation with the low portions 120 of the camming surface 110 of the camming structure 64, the movable camming member 58 is spaced from the base portion 30 in the position shown in FIG. 3. When the manually operable portion 38 is rotated, the camming structure 64 rotates to a position in which the low portions 122 on the movable camming member 58 are engaged in overlying relation with the raised portions 116 on the camming structure 64 so that the movable camming member 58 is moved upwardly to its fullest extent. As the movable camming member 58 moves upwardly, the club retaining portion 32 moves to its club retaining position relative to the base portion 30 of the club retaining assembly 26. More specifically, the upward movement of the movable camming member 58 causes the camming surfaces 66 on the movable camming member 58 to cam the cammable fingers 50 inwardly with respect to the club receiving openings 28 so that each of the shoulder engaging surfaces 34 is positioned to engage the shoulder surface 24 on the grip 22 of an associated club 16 to affect the club retaining position of the club retaining assembly 26. This position is shown in FIG. 5.

It should be noted that the shoulder engaging surfaces 34 have an arcuate shape. This arcuate shape provides more contact area between the club shaft and the shoulder engaging surface 34 in comparison to a straight engaging surface. Specifically, a straight engaging surface will only provide tangential contact with club shaft whereas an arcuate surface can better conform to the cylindrical shape of the shaft.

It can also be appreciated that as the movable camming member 58 moves upwardly, a spring 114 mounted about the tubular portion 54 between the base portion 30 and the movable camming member 58 is resiliently compressed. The spring 114 biases the movable camming member 58 downwardly with respect to the actuating mechanism 36.

As the manually operable portion 38 is rotated to move the movable camming member 58 upwardly and thereby to move the club retaining portions 32 of the club retaining assembly 26 inwardly to their club retaining positions, the arm member 94 of the manually operable portion 38 rotates to affect the bag securing position of the bag securing assembly 40.

More specifically, the concave interiorly facing surface 96 of the arm member 94 and the concave exteriorly facing surface 92 of the base portion 30 are constructed and arranged such that the flexible cable 82 can be wrapped around the fixed object 42 and the lockable member 84 can be positioned on the concave exteriorly facing surface 92 when the manually operable portion 38 is rotated. As the manually operable portion 38 rotates to move the cammable fingers 50 inwardly with respect to the club receiving openings 28, the concave interiorly facing surface 96 is rotated to a position such that the interiorly facing surface 96 of the arm member 94 and the exteriorly facing surface 92 of the base portion 30 cooperate to prevent removal of the lockable member 84, thereby realizing the bag securing position of the bag securing assembly 40. The single releasable lock 44 can thereafter be moved into its locked position in which the locking rod 104 enters the bore 108 (as shown in FIG. 6) locking both the club retaining portion 32 in the club retaining position thereof and the bag securing assembly 40 in the bag securing position thereof by preventing rotation of the camming structure 64 of the actuating mechanism 36.

To use the golf bag 12 again to play golf, the golfer uses the key 100 to move the releasable lock to a released position which slides the locking rod 104 out of the bore 108 so the actuating mechanism 36, including the camming structure 64, can be rotated with respect to the club retaining assembly 26. As the manually operable portion 38 rotates, the movable camming member 58 moves downwardly under the biasing of spring 114 to allow the club retaining portion 32 of the club retaining assembly 26 to return to the club releasing position wherein the shoulder engaging surfaces 34 are positioned to allow the clubs to be removed from the golf bag 12. The rotation of the manually operable portion 38 moves the concave interiorly facing surface 96 of the arm member 94 away from the concave exteriorly facing surface 92 of the base portion 30 to allow the golfer to remove the lockable member 84 from the concave exteriorly facing surface 92. This allows the spool 86 to rotate in a winding direction to wind the flexible cable 82 thereabout so that the bag securing assembly 40 returns to the bag releasing position to allow the golfer to carry the bag away from the fixed object 42.

Figure 8:
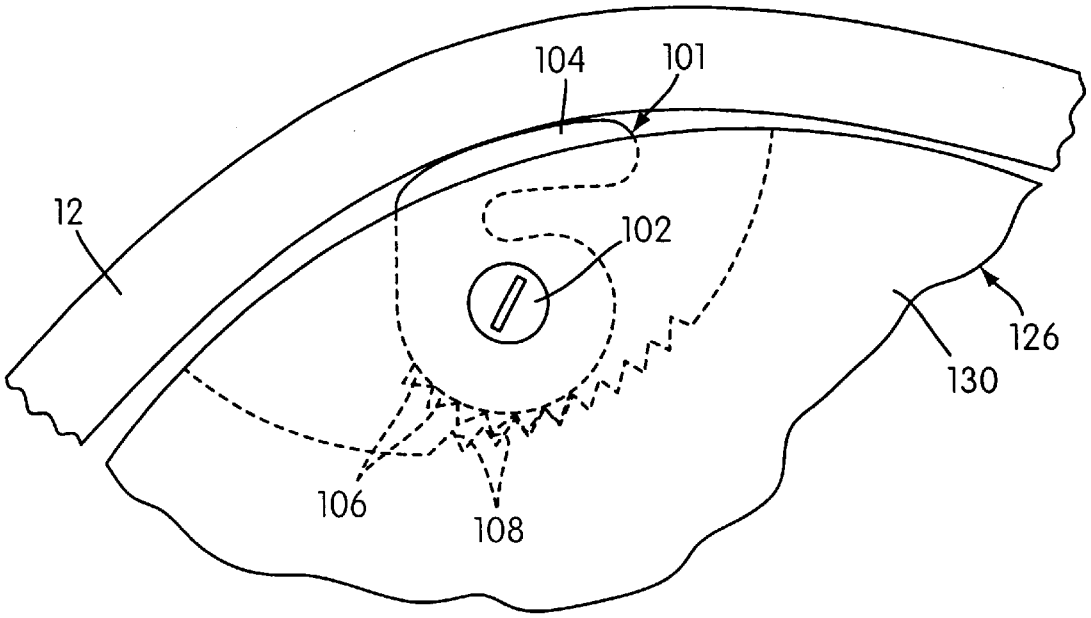
FIG. 8 is a view of an alternative embodiment of a device for securing the golf bag security device in a conventional golf bag shown in phantom lines.

FIG. 8 shows an alternative embodiment of a mechanism for securing the club retaining assembly 26 within the golf bag 12. A bag mounting structure 101 is pivotally mounted within the base portion 130 of the club retaining assembly 126 by a screw 102, the head of which is on the exterior of the base portion 130 and flush with the top surface thereof. The screw 102 is rigidly secured to the bag mounting structure 101 and a free end of the screw 102 is pivotally engaged within a bore (not shown) in the base portion 130.

To mount the club retaining assembly 126 in the golf bag 12 with the bag mounting structure 101, the club retaining assembly 126 is placed in the golf bag 12 and the screw structure 102 is rotated (in a counterclockwise direction as shown in FIG. 8) with a screwdriver or other appropriate hand tool. As the bag mounting structure 101 pivots, an elongated leg 104 integrally formed on the bag mounting structure 101 pivots into biasing and gripping engagement with the inner surface of the golf bag 12 to hold the club retaining assembly 126 in place. It can be understood that although only one bag mounting structure 101 is shown in the figures, a plurality of circumferentially spaced bag mounting structures 101 are provided around the outer edge of the base portion 130. The bag mounting structure 101 is restricted to counterclockwise rotation by and rotationally locked in place by a series of teeth 106 on the bag mounting structure 101 that engage complimentary teeth 108 integrally formed on the base portion 130. It can be appreciated that when the club retaining assembly 26 is installed in the golf bag 12 with the bag mounting structure 101, the club retaining assembly 26 is permanently mounted in the bag. It is contemplated to provide a plurality of gripping teeth on the bag engaging edge of the leg structure 104 of the bag mounting structure 101.

Figure 9:
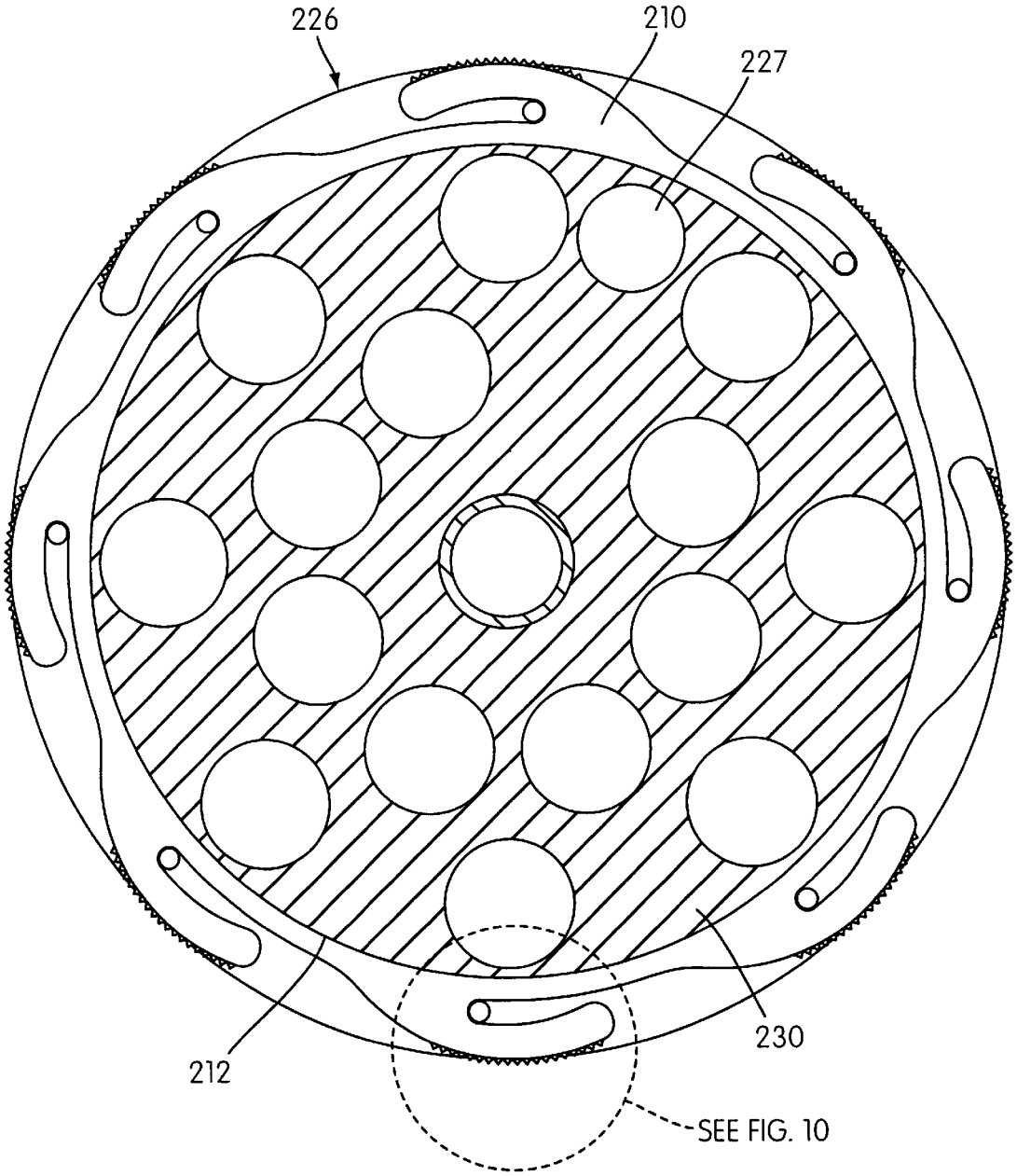
FIG. 9 is a sectional view of a second alternative embodiment of a device for securing the golf bag security device in a conventional golf bag shown in phantom lines, the section being taken through the base portion.
Figure 10:
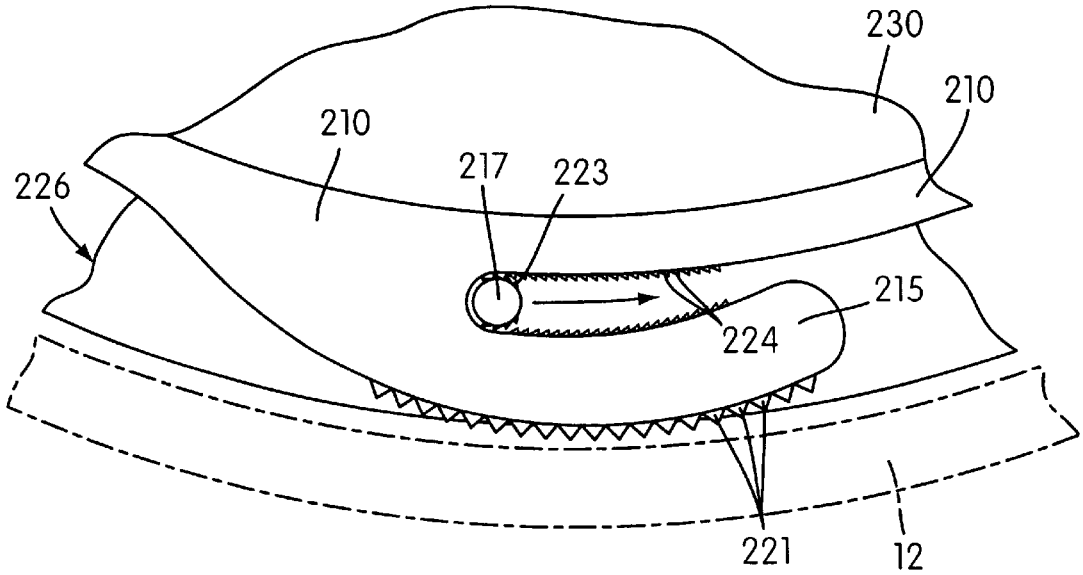
FIG. 10 is an enlarged fragmentary view of the mounting member utilized in the embodiment of FIG. 9 before the base has been rotated.
Figure 11:
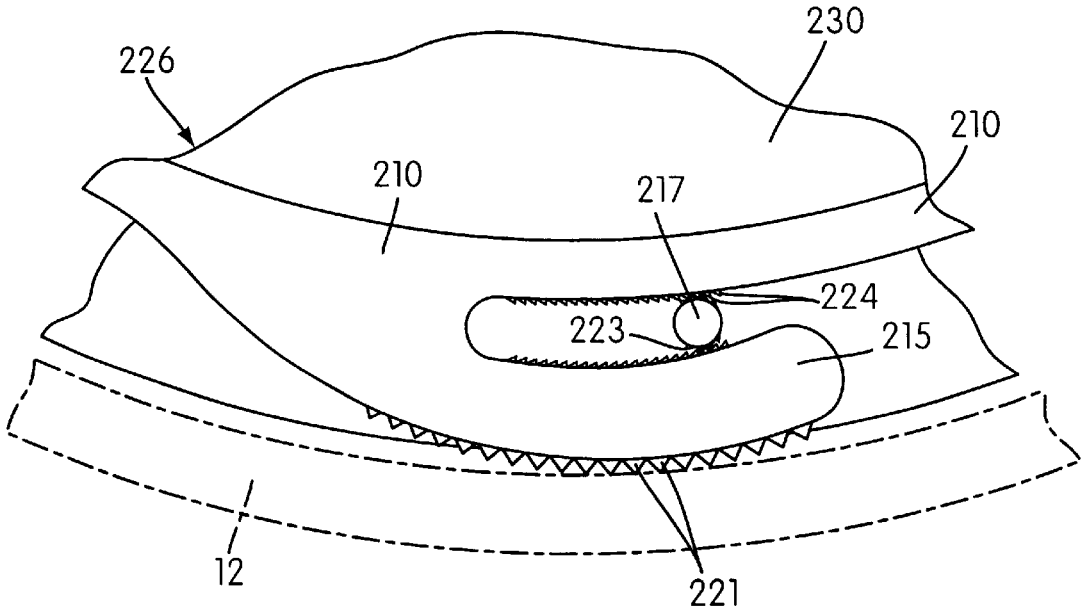
FIG. 11 is an enlarged fragmentary view similar to FIG. 10 after the base has been rotated.

FIGS. 9–11 show a second alternative arrangement for mounting a club retaining assembly 226 in a golf bag 12 (the bag is not shown in FIG. 9, but is shown in FIGS. 10–11). FIG. 9 is a sectional view taken through the base portion 230 with the lock cylinder removed, thus leaving bore 227 open. The club retaining assembly 226 includes a mounting member 210 that is rotatably mounted about an annular wall portion 212 integrally formed on the base portion 230 by a groove that extends around the periphery thereof. The mounting member 210 includes a plurality of circumferentially spaced integral leg structures 215 that cooperate with a plurality of posts 217 integrally formed on the base portion 230 to mount the club retaining assembly 226 to the golf bag 12.

The mounting member 210 is preferably made of a resilient, flexible elastomeric or composite material such as rubber or rubberized plastic. The club retaining assembly 226 is mounted in the golf bag 12 by positioning the same in the top of the golf bag 12 and rotating the base portion 230 with respect to the mounting member 210 in a locking direction (counterclockwise in the bottom view of FIG. 9). FIGS. 10–11 show in enlarged fragmentary view the effect of this rotational movement. The legs 215 frictionally engage the inner surface of the bag 12 to prevent or retard rotation of the mounting member 210 as the base portion 230 is being rotated.

FIG. 10 shows the relative positions of the mounting member 210 and the base portion 230 before the relative rotational movement is commenced. A directional arrow in FIG. 10 shows the direction of rotational movement of the base portion 230 with respect to mounting member 210 to install the retaining assembly 26 in the golf bag 12.

Rotational movement of the base portion 230. moves the integral posts 217 with respect to the leg structures 215. FIGS. 10–11 show one leg structure 215 in isolation. As the post 217 moves with respect to the mounting member 210 from the position shown in FIG. 10 to the position shown in FIG. 11, gripping teeth 221 on the outer edge of the leg structure 215 are biased outwardly into gripping engagement with the golf bag 12 to hold the club retaining assembly 226 in the bag. Interlocking teeth 223, 224 on the post 217 and mounting member 210, respectively, prevent clockwise rotation (from the perspective shown in FIGS. 9–11) of the base portion 230 with respect to the mounting member 210 to maintain the club retaining assembly 226 in the golf bag 12.

Figure 12:
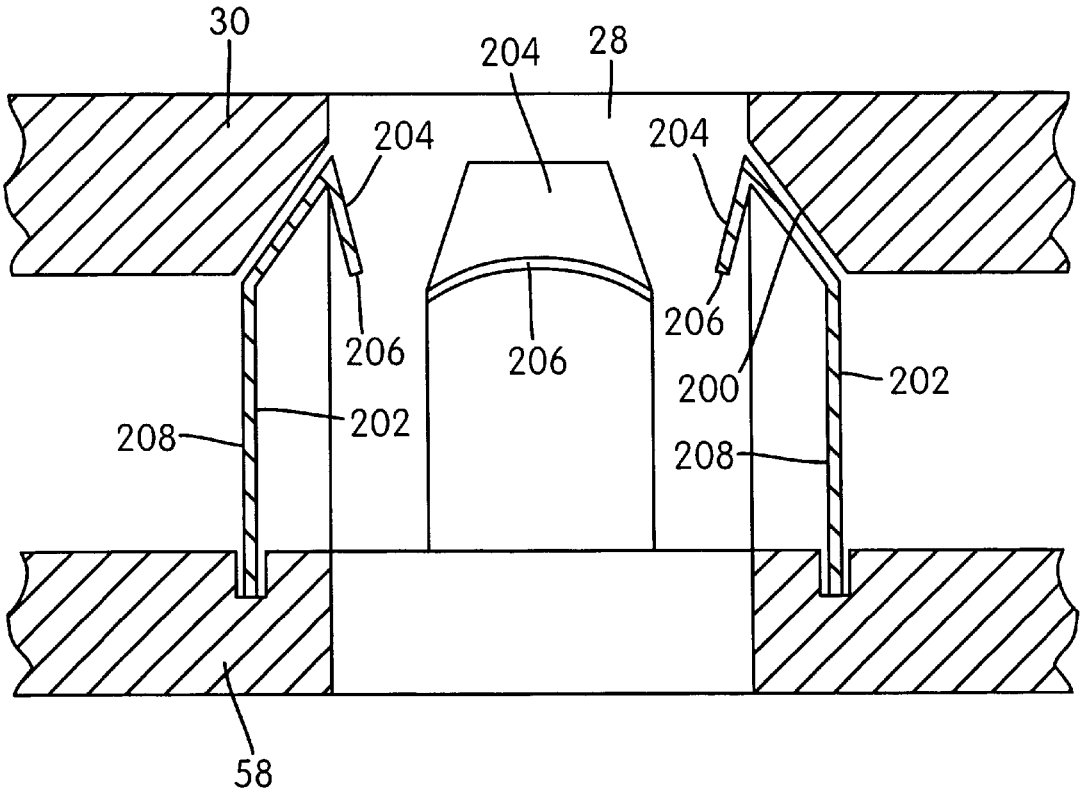
FIG. 12 is sectional view showing an alternative arrangement for the cammable fingers.

FIG. 12 shows an alternative arrangement for securing the clubs within the bag 12. The alternative arrangement is basically the same as the first embodiment except that the base portion 30 has camming surfaces 200 formed on the inside of the club receiving openings 28. Cammable fingers 202 are press-fit or otherwise mounted to the movable member 58. The fingers 202, like fingers 50, are made of plastic coated spring steel or may be pivotally mounted in conjunction with biasing element.

The fingers 202 have folded-over head portions 204 which provide arcuate shoulder engaging surfaces 206. The body 208 of each finger 202 has side edges which inwardly towards the peak of the fold and the head portion 204 has side edges which taper outwardly towards the engaging surface 206. The inward taper on the bodies 208 ensures that the bodies 208 of adjacent fingers 202 will not interfere with each other during inward movement and the outward taper on the head portions 204 maximizes the length of the engaging surfaces 206. Increasing the length of engaging surface 204 increases the overall contact area between the club and the surfaces 206.

The exterior surfaces of the head portions 204 define cammable surfaces 210. As the movable member 58 is moved upwardly towards the base portion 30 in the manner described above, the camming surfaces 200 and the cammable surfaces 210 will be engaged in a camming relationship. The camming relationship will cause the fingers 202 to move inwardly to the club retaining positon.

It can be understood that the preferred embodiment of the invention shown above is exemplary only and that variations of the device are within the scope of the present invention. Additional advantages and modifications will readily occur to those skilled in the art. Therefore, the invention is not limited to the specific details and representative embodiments shown and described herein. Accordingly, various modifications to the embodiments may be made without departing from the spirit or scope of the invention as described in the appended claims.

What is claimed is:

1. A golf bag security device for installation on a golf bag having an open interior space configured to receive a plurality of golf clubs, each of the clubs having an elongated shaft with a head on one end thereof and a manually engageable grip on the other end thereof, the grip defining a shoulder surface facing generally towards the head, said device comprising:

a club retaining assembly constructed and arranged to be securely mounted to the bag to thereby install said device with one side thereof facing exteriorly with respect to the bag opening and the other side thereof facing interiorly with respect to the bag opening; said club retaining assembly having a plurality of club receiving openings, each of said openings being positioned and configured to receive an associated one of the golf clubs with the head thereof disposed exteriorly of the club retaining assembly and the grip thereof disposed interiorly of the club retaining assembly when said device is installed;

said club retaining assembly providing shoulder engaging surfaces that face interiorly into the bag when said device is installed;

said club retaining assembly includes a base portion and a club retaining portion, said club retaining portion being movable relative to said base portion and said club retaining portion providing said shoulder engaging surfaces of said club retaining assembly;

said club retaining portion includes a multiplicity of cammable fingers depending from said base portion with a number of said cammable fingers being arranged around each of said club receiving openings, said fingers providing said shoulder engaging surfaces;

said club retaining assembly being movable between (1) a club retaining position wherein said shoulder engaging surfaces are positioned with respect to said club receiving openings such that the shoulder surface on the grip of an associated club engages an associated shoulder engaging surface during outward movement of the associated club relative to the club receiving opening in which it is received to thereby prevent attempted club removal through said club receiving openings and (2) a club releasing position wherein said shoulder engaging surfaces are positioned with respect to said club receiving openings to allow the clubs to be removed outwardly from the bag through said club receiving openings; a bag securing assembly integrated within said golf bag security device, said bag securing assembly being movable between (1) a bag securing position wherein said securing assembly secures the golf bag to a fixed object when said device is installed, thereby preventing the bag with the clubs therein from being carried away and (2) a bag releasing position wherein said bag securing assembly can be released from the fixed object so that the bag with the clubs therein can be carried away from the fixed object;

a single releasable lock integrated within said golf bag security device, said lock being constructed and arranged to be moved between (a) a releasably locked position locking both said club retaining assembly in said club retaining position thereof and said bag securing assembly in said bag securing position thereof, and (b) a released position allowing both said club retaining assembly to be moved to said club releasing position thereof and said bag securing assembly to be moved to said bag releasing position thereof; and an actuating mechanism operatively associated with said club retaining assembly and having a manually operable portion, said actuating mechanism being constructed and arranged such that manual operation of said manually operable portion moves said club retaining assembly between said club retaining and club releasing positions thereof;

wherein said actuating mechanism comprising a moveable camming member having camming surfaces operatively associated with each of said cammable fingers; and said actuating mechanism being constructed and arranged such that manual operation of said manually operable portion moves said camming member such that the camming surfaces thereof cam said cammable fingers inwardly with respect to said club receiving openings so that each of said shoulder engaging surfaces is positioned to engage the shoulder surface on the grip of an associated club during outward movement of the associated club so as to prevent attempted club removal, thereby realizing the club retaining position of said club retaining assembly.

2. A golf bag security device according to claim 1, wherein said cammable fingers have cammable surfaces that taper towards one another in a direction away from said base portion and wherein manual operation of said manually operable portion moves said movable member towards said base portion so as to cam said cammable fingers inwardly with respect to said club receiving openings.

3. A golf bag security device according to claim 2, wherein said manually operable portion is rotatably mounted to said base portion such that rotational movement of said manually operable portion moves said movable camming member towards and away from said base portion.

4. A golf bag security device according to claim 1, wherein said bag securing assembly comprises a flexible cable configured to be wrapped around the fixed object.

5. A golf bag security device according to claim 4, wherein said cable has a lockable member on a free end thereof;

said club retaining assembly having a concave exteriorly facing surface configured to receive said lockable member;

said manually operable portion of said actuating mechanism comprising an arm member with a concave interiorly facing surface;

said concave interiorly facing surface of said arm member and said concave exteriorly facing surface of said club retaining assembly being constructed and arranged such that said lockable member can be wrapped around the fixed object and positioned on said concave exteriorly facing surface, said manually operable portion can then be rotated such that (1) said cammable fingers are cammed inwardly with respect to said club receiving openings and (2) said concave interiorly facing surface is positioned such that said interiorly facing surface and said concave exteriorly facing surface cooperate to prevent removal of said lockable member, thereby realizing said bag securing position of said bag securing assembly, and said releasable lock can thereafter be moved into said locked position locking both said club retaining assembly in said club retaining position thereof and said bag securing assembly in said bag securing position thereof.

6. A golf bag security device according to claim 1, wherein said base portion is generally circular.

7. A golf bag security device according to claim 1, wherein said golf bag securing device comprises a flexible cable configured to be wrapped around the fixed object.

8. A golf bag security device for installation on a golf bag having an open interior space configured to receive a plurality of golf clubs, each of the clubs having an elongated shaft with a head on one end thereof and a manually engageable grip on the other end thereof, the grip defining a shoulder surface facing generally towards the head, said device comprising:

a base portion constructed and arranged to be securely mounted to the bag to thereby install said device with one side thereof facing exteriorly with respect to the bag opening and the other side thereof facing interiorly with respect to the bag opening, said base portion having a first plurality of club receiving openings formed therethrough, each of said openings being positioned and configured to receive an associated single one of the golf clubs with the head thereof disposed exteriorly of the base portion and the grip thereof disposed interiorly of the base portion when said device is installed;

an actuating mechanism comprising a manually operable portion and a movable member that is movable relative to said base portion, said movable member having a second plurality of club receiving openings aligned with the club receiving openings of said base portion to define a plurality of pairs of aligned club receiving openings;

a multiplicity of club retaining fingers with a number of said fingers being arranged around each pair of aligned club receiving openings of said base portion and said movable member, each of said fingers extending generally radially inwardly with respect to its associated pair of aligned club receiving openings and providing a shoulder engaging surface that faces interiorly into the bag when said device is installed;

said actuating mechanism being constructed and arranged such that, when said device is installed and a plurality of the clubs are received in said aligned club receiving openings, manual operation of said manually operable portion moves said movable member relative to said base portion between (1) a club retaining position wherein said fingers are moved inwardly towards the shafts of the clubs so that said shoulder engaging surfaces are positioned with respect to said pairs of aligned club receiving openings such that the shoulder surface on the grip of an associated club engages an associated shoulder engaging surface during outward movement of the associated club relative to the club receiving opening in which it is received to thereby prevent attempted club removal and (2) a club releasing position wherein said club retaining fingers are moved outwardly away from the shafts of the clubs such that each of said shoulder engaging surfaces are positioned with respect to said club receiving openings to allow the clubs to be removed outwardly from the bag;

a releasable lock constructed and arranged to be moved between a releasably locked position locking said movable member in said club retaining position thereof and a released position allowing said movable member to be moved to said club releasing position thereof.

9. A golf bag security device according to claim 8, wherein said club retaining fingers are carried by said movable member.

10. A golf bag security device according to claim 8, wherein said club retaining fingers are carried by said base portion.

11. A golf bag security device according to claim 8, wherein the manually operable portion of said actuating mechanism is rotatably mounted to said base portion such that rotational movement of said manually operable portion moves said movable member towards and away from said base portion.

12. A golf bag security device according to claim 8, further comprising:

a bag securing assembly that moves between (1) a bag securing position wherein said securing assembly secures the golf bag to a fixed object when said device is installed, thereby preventing the bag with the clubs therein from being carried away and (2) a bag releasing position wherein the bag securing assembly can be released from the fixed object so that the bag with the clubs therein can be carried away from the fixed object;

wherein said releasable lock is constructed and arranged to lock both said movable member in said club retaining position thereof and said bag securing assembly in the bag securing position thereof.

13. A golf bag security device according to claim 10, wherein said bag securing assembly comprises a flexible cable that is configured to be wrapped around the fixed object.

14. A golf bag security device according to claim 8, wherein one of said base portion and said movable member provide a series of camming surfaces that cam said fingers inwardly with respect to said club receiving openings as said movable member is being moved into the club retaining position thereof.

15. A golf bag security device for installation on a golf bag having an open interior space configured to receive a plurality of golf clubs, each of the clubs having an elongated shaft with a head on one end thereof and a manually engageable grip on the other end thereof, the grip defining a shoulder surface facing generally towards the head, said device comprising:

a club retaining assembly constructed and arranged to be securely mounted to the bag to thereby install said device with one side thereof facing exteriorly with respect to the bag opening and the other side thereof facing interiorly with respect to the bag opening;

said club retaining assembly having a plurality of club receiving openings formed therethrough, each of said openings being positioned and configured to receive an associated one of the golf clubs with the head thereof disposed exteriorly of the club retaining assembly and the grip thereof disposed interiorly of the club retaining assembly when said device is installed;

said club retaining assembly providing shoulder engaging surfaces that face interiorly into the bag when said device is installed;

said club retaining assembly being movable between (1) a club retaining position wherein said shoulder engaging surfaces are positioned with respect to said club receiving openings such that the shoulder surface on the grip of an associated club engages an associated shoulder engaging surface during outward movement of the associated club relative to the club receiving opening in which it is received to thereby prevent attempted club removal through said club receiving openings and (2) a club releasing position wherein said shoulder engaging surfaces are positioned with respect to said club receiving openings to allow the clubs to be removed outwardly from the bag through said club receiving openings, said club retaining assembly being lockable in said club retaining position;

an actuating mechanism operatively associated with said club retaining assembly and having a manually operable portion, said actuating mechanism being constructed and arranged such that manual operation of said manually operable portion moves said club retaining assembly between said club retaining and club releasing positions thereof; and a bag securing assembly comprising a flexible cable and a cable retractor, said retractor being constructed and arranged to enable said cable to be extended from a storage position to an extended position for locked securement to a fixed object when said device is installed, thereby preventing the bag with the clubs therein from being carried away, said retractor being constructed and arranged to automatically retract said cable from said extended position to said storage position;

wherein said club retaining assembly comprises a base portion and a club retaining portion, said club retaining portion being movable relative to said base portion and said club retaining portion providing said shoulder engaging surfaces of said club retaining assembly; said club retaining portion comprises a multiplicity of cammable fingers depending from said base portion with a number of said cammable fingers being arranged around each of said club receiving openings;

said fingers providing said shoulder engaging surfaces; said actuating mechanism comprising a movable camming member having camming surfaces operatively associated with each of said cammable fingers;

said actuating mechanism being constructed and arranged such that manual operation of said manually operable portion moves said movable camming member such that the camming surfaces thereof cam said cammable fingers inwardly with respect to said club receiving openings so that each of said shoulder engaging surfaces is positioned to engage the shoulder surface on the grip of an associated club during outward movement of the associated club so as to prevent attempted club removal, thereby realizing the club retaining position of said club retaining assembly.

16. A golf bag security device according to claim 15, wherein said retractor comprises a spool on which said cable is wound.

17. A golf bag security device according to claim 16, wherein said retractor comprises a spring constructed and arranged to bias said spool in a winding direction to provide said automatic retraction of said cable from said extended position to said storage position.

18. A golf bag security device according to claim 15, further comprising a single lock constructed and arranged to be moved between a releasably locked position locking both said club retaining assembly in said club retaining position thereof and said cable in said extended position thereof in securement with the fixed object, and a released position allowing both said club retaining assembly to be moved to said club releasing position thereof and said cable to be automatically retracted from said extended position to said storage position.

19. A golf bag security device according to claim 15, wherein said cammable fingers have cammable surfaces that taper towards one another in a direction away from said base portion and wherein manual operation of said manually operable portion moves said movable camming member towards said base portion so as to cam said cammable fingers inwardly with respect to said club receiving openings.

20. A golf bag security device according to claim 19, wherein said manually operable portion is rotatably mounted to said base portion such that rotational movement of said manually operable portion moves said movable camming member towards and away from said portion.

21. A golf bag security device according to claim 15, wherein said cable has a lockable member on a free end thereof;

said club retaining assembly having a concave exteriorly facing surface configured to receive said lockable member;

said manually operable portion of said actuating mechanism comprising an arm member with a concave interiorly facing surface;

said concave interiorly facing surface of said arm member and said concave exteriorly facing surface of said club retaining assembly being constructed and arranged such that said cable can be wrapped around the fixed object and then said lockable member can be positioned on said concave exteriorly facing surface, said manually operable portion can then be rotated such that (1) said cammable fingers are cammed inwardly with respect to said club receiving openings and (2) said concave interiorly facing surface is positioned such that said interiorly facing surface and said exteriorly facing surface cooperate to prevent removal of said lockable member, thereby realizing securement of said cable to the fixed object, and said releasable lock can thereafter be moved into said locked position locking said club retaining assembly in said club retaining position thereof and locking said cable in securement to the fixed object.

22. A golf bag security device for installation on a golf bag having an open interior space configured to receive a plurality of golf clubs, each of the clubs having an elongated shaft with a head on one end thereof and a manually engageable grip on the other end thereof, the grip defining a shoulder surface facing generally towards the head, said device comprising:

a club retaining assembly constructed and arranged to be securely mounted to the bag to thereby install said device with one side thereof facing exteriorly with respect to the bag opening and the other side thereof facing interiorly with respect to the bag opening;

said club retaining assembly having a plurality of club receiving openings, each of said openings being positioned and configured to receive an associated one of the golf clubs with the head thereof disposed exteriorly of the club retaining assembly and the grip thereof disposed interiorly of the club retaining assembly when said device is installed;

said club retaining assembly providing shoulder engaging surfaces that face interiorly into the bag when said device is installed;

said club retaining assembly being movable between (1) a club retaining position wherein said shoulder engaging surfaces are positioned with respect to said club receiving openings such that the shoulder surface on the grip of an associated club engages an associated shoulder engaging surface during out ward movement of the associated club relative to the club receiving opening in which it is received to thereby prevents attempted club removal through said club receiving openings and (2) a club releasing position wherein said shoulder engaging surfaces are positioned with respect to said club receiving openings to allow the clubs to be removed outwardly from the bag through said club receiving openings;

an actuating mechanism operatively associated with said club retaining assembly and having a manually operable portion, said actuating mechanism being constructed and arranged such that manual operation of said manually operable portion moves said club retaining assembly between said club retaining and club releasing positions thereof;

a bag securing assembly that moves between (1) a bag securing position wherein said securing assembly secures the golf bag to a fixed object when said device is installed, thereby preventing the bag with the clubs therein from being carried away and (2) a bag releasing position wherein said bag securing assembly can be released from the fixed object so that the bag with the clubs therein can be carried away from the fixed object; and a single releasable lock constructed and arranged to be moved between (a) a releasably locked position locking both said club retaining assembly in said club retaining position thereof and said bag securing assembly in said bag securing position thereof, and a released position allowing both said club retaining assembly to be moved to said club releasing position thereof and said bag securing assembly to be moved to said bag releasing position thereof;

said bag securing assembly comprising a flexible cable configured to be wrapped around the fixed object, said cable having a lockable member on a free end thereof;

said club retaining assembly having a concave exteriorly facing surface configured to receive said lockable member;

said manually operable portion of said actuating mechanism comprising an arm member with a concave interiorly facing surface;

said concave interiorly facing surface of said arm member and said concave exteriorly facing surface of said club retaining assembly being constructed and arranged such that said lockable member can be wrapped around the fixed object and positioned on said concave exteriorly facing surface, then said manually operable portion can be manually operated such that (1) said club retaining assembly is moved to said club retaining position thereof and (2) said concave interiorly facing surface is positioned such that said interiorly facing surface and said concave exteriorly facing surface cooperate to prevent removal of said lockable member, thereby realizing said bag securing position of said bag securing assembly, and said releasable lock can thereafter be moved into said locked position locking both said club retaining assembly in said club retaining position thereof and said bag securing assembly in said bag securing position thereof.

23. A golf bag security device according to claim 22, wherein said club retaining assembly comprises a base portion and a club retaining portion, said club retaining portion being movable relative to said base portion and said club retaining portion providing said shoulder engaging surfaces of said club retaining assembly.

24. A golf bag security device according to claim 23, wherein said club retaining portion comprises a multiplicity of cammable fingers depending from said base portion with a number of said cammable fingers being arranged around each of said club receiving openings;

said fingers providing said shoulder engaging surfaces;

said actuating mechanism comprising a movable camming member having camming surfaces operatively associated with each of said cammable fingers;

said actuating mechanism being constructed and arranged such that manual operation of said manually operable portion moves said movable camming member such that the camming surfaces thereof cam said cammable fingers inwardly with respect to said club receiving openings so that each of said shoulder engaging surfaces is positioned to engage the shoulder surface on the grip of an associated club during outward movement of the associated club so as to prevent attempted club removal, thereby realizing the club retaining position of said club retaining assembly.

25. A golf bag security device according to claim 24, wherein said cammable fingers have cammable surfaces that taper towards one another in a direction away from said base portion and wherein manual operation of said manually operable portion moves said movable member towards said base portion so as to cam said cammable fingers inwardly with respect to said club receiving openings.

26. A golf bag security device according to claim 25, wherein said manually operable portion is rotatably mounted to said base portion such that rotational movement of said manually operable portion moves said movable camming member towards and away from said base portion.

27. A golf bag security device according to claim 22, wherein said bag securing assembly further comprises a cable retractor constructed and arranged to enable said cable to be extended from a storage position to an extended position for wrapping around a fixed object, said retractor being constructed and arranged to automatically retract said cable from said extended position to said storage position.

28. A golf bag security device according to claim 27, wherein said retractor comprises a spool on which said cable is wound.

29. A golf bag security device according to claim 28, wherein said retractor comprises a spring constructed and arranged to bias said spool in a winding direction to provide said automatic retraction of said cable from said extended position to said storage position.

* * * * *